US006161551A

United States Patent [19]

Sakuma et al.

[11] Patent Number: 6,161,551

[45] Date of Patent: Dec. 19, 2000

[54] AUTOMATIC SMOKING MACHINE

[75] Inventors: Yuzuru Sakuma; Yasumasa Tomita; Tomoyoshi Kitamoto, all of Hiratsuka; Takao Tozawa, Tokyo, all of Japan

[73] Assignee: Japan Tobacco Inc., Tokyo, Japan

[21] Appl. No.: 09/101,090

[22] PCT Filed: Oct. 28, 1997

[86] PCT No.: PCT/JP97/03906

§ 371 Date: Jul. 1, 1998

§ 102(e) Date: Jul. 1, 1998

[87] PCT Pub. No.: WO98/20318

PCT Pub. Date: May 14, 1998

[30] Foreign Application Priority Data

| | | | |
|---|---|---|---|
| Nov. 1, 1996 | [JP] | Japan | 8-291986 |
| Nov. 1, 1996 | [JP] | Japan | 8-291987 |
| Nov. 1, 1996 | [JP] | Japan | 8-291988 |
| Nov. 1, 1996 | [JP] | Japan | 8-291989 |

[51] Int. Cl.[7] ..... A24C 5/32

[52] U.S. Cl. ..... 131/330

[58] Field of Search ..... 131/330, 346, 131/908, 331

[56] References Cited

U.S. PATENT DOCUMENTS 4,919,342 4/1990 Narukawa .

4,993,646 2/1991 Narukawa .

5,411,039 5/1995 Sakuma et al. .

OTHER PUBLICATIONS

Abstract of JP 63–142650.

Abstract of JP 1–59033.

*Primary Examiner*—Stanley S. Silverman
*Assistant Examiner*—Robert McBride
*Attorney, Agent, or Firm*—Birch, Stewart, Kolasch & Birch, LLP

[57] ABSTRACT

In an automatic smoking machine for automatically attaching holders and tobacco rolls to smoking mouths of a smoking apparatus body by means of a robot apparatus, arranged in front of the smoking apparatus body, a holder tray supplying mechanism and a roll tray supplying mechanism are provided near an end portion of a rail of the robot apparatus. The holder tray supplying mechanism and the roll tray supplying mechanism hold a plurality of holder trays and roll trays, holding holders and tobacco rolls of the required numbers. The holder trays and roll trays are supplied one by one to an operation range of the robot body. As a result, a completely automatic operation can be continuously performed for a long period of time.

9 Claims, 10 Drawing Sheets

AUTOMATIC SMOKING MACHINE

This application is the national phase under 35 U.S.C. §371 of prior PCT International Application No., PCT/JP97/03906, which has an International filing date of Oct. 28, 1997, which designated the United States of America, the entire contents of which are hereby incorporated by reference.

BACKGROUND OF THE INVENTION

1. Technical Field

The present invention relates to an automatic smoking machine for automatically smoking rolls of tobacco such as cigarettes and automatically analyzing compositions contained in the smoke. More specifically, the present invention relates to an automatic smoking machine, wherein rolls of tobacco or holders can be automatically attached to smoking mouths of the automatic smoking machine, efficiently without failure, so that an automatic operation can be performed continuously for a long period of time.

2. Background Art

When rolls of tobacco such as cigarettes are manufactured and sold, it is necessary to analyze the components contained in the smoke produced when the rolls of tobacco are smoked, and indicate the contents.

However, since tobacco leaves are a farm product, the quality thereof is not accurately constant. Therefore, when producing tobacco rolls, samples are extracted in a ratio of a predetermined number to the number of the products, the samples are smoked by a smoking machine, and the number of puffs of a roll and the burning speed are measured and the components contained in the smoke are analyzed. A smoking machine is used to automatically perform the analysis. The smoking machine has a number of smoking mouths. Holders are attached to the smoking mouths, and tobacco rolls such as cigarettes are attached to the holders; that is, the tobacco rolls (e.g., cigarettes) are attached to the machine via the holders. Top ends of the attached tobacco rolls are lighted by a heater or the like. The smoking machine inhales air through the tobacco rolls at a predetermined pattern in accordance with standard smoking conditions, thereby smoking the tobacco rolls. Cambridge filters are provided in the holders to collect the components, such as nicotine and tar. The other components in the smoke inhaled into the smoking machine through the Cambridge filters are analyzed by a gas analysis apparatus.

An automatic smoking machine has been developed, in which a series of jobs, such as attachment of the tobacco rolls to the smoking machine, lighting, extinguishment, and removal of cigarette stubs, are automatically performed. Such an automatic smoking machine comprises a smoking apparatus and a robot apparatus for automatically performing the above jobs. The robot apparatus has an arm of, for example, a jointed type. For example, a roll hand for picking up rolls, a lighter hand for lighting, and a cutter hand for extinguishment are sequentially attached to a top end portion of the arm, so that the above-mentioned series of jobs are performed.

In the smoking test as described above, a great number of tobacco rolls are smoke-tested in accordance with a predetermined program. Therefore, a great number of tobacco rolls and holders to be used in the smoking test are required in a day. As a method for efficiently supplying a great number of holders or tobacco rolls, for example, holders of the same number as that of the smoking mouths, and tobacco rolls to be attached to the holders (a plurality of rolls are attached to each holder) may be held in a holder tray and a roll tray, and the holders and tobacco rolls may be supplied to the automatic smoking machine in unit of a holder tray and a roll tray.

However, the automatic smoking machine has a robot apparatus for attachment of the holders and rolls, lighting and cutting, and while the robot apparatus is operating, a worker cannot enter the operation range. Therefore, since the operation of the robot apparatus must be stopped completely to supply the holder tray and roll tray, the job is stopped for a long period of time, resulting in reduction of the efficiency. Further, when a malfunction occurs in the series of automatic jobs, the operation of the robot apparatus must first be stopped completely, and thereafter the cause of the malfunction must be removed and the apparatus must be restored, which also results in reduction of the efficiency.

In general, since tobacco is a farm product, sizes or characteristics of tobacco rolls are not accurately constant. In addition, since tobacco rolls are soft and easily deformed, it is difficult to automatically handle them by a robot or the like, and various malfunctions may easily occur during the operation. Therefore, to perform the jobs continuously and efficiently without interrupting the jobs, it is necessary to increase the reliability in handling of the tobacco rolls and the other operations.

SUMMARY OF THE INVENTION

The present invention has been made on the basis of the above situations, and its object is to provide an automatic smoking machine, to which holders and tobacco rolls are automatically supplied, which can efficiently and automatically perform jobs continuously for a long period of time without stopping the operation of the robot apparatus, and which has a high safety.

To achieve the above object, an automatic smoking machine of the present invention comprises: a smoking apparatus body; a plurality of smoking mouths arranged on a front surface of the smoking apparatus body; and a robot apparatus, arranged in front of the smoking apparatus body, for attaching holders and tobacco rolls to the smoking mouths and lighting the tobacco rolls, wherein: the robot apparatus comprises: a rail extending along a direction of arrangement of the smoking mouths on the front surface of the smoking apparatus; and a robot body movable along the rail; and a holder tray supplying mechanism and a roll tray supplying mechanism are provided near an end portion of the rail, the holder tray supplying mechanism and the roll tray supplying mechanism holding a plurality of holder trays and roll trays, the holder trays and roll trays being supplied one by one to an operation range of the robot body, and each of the holder trays and roll trays holding a plurality of holders and tobacco rolls.

The holders and tobacco rolls of the number required for a programmed serial smoking test is supplied in units of trays, and when the serial smoking test is completed, the robot body of the robot apparatus is moved to the end portion of the rail and receives the holders and tobacco rolls, with the result that the efficiency is improved. Further, since the holder tray supplying mechanism and the roll tray supplying mechanism hold a plurality of holder trays and roll trays, which are supplied one by one, a worker need not enter the operation range of the robot apparatus. Therefore, it is unnecessary to stop the operation of the robot apparatus, resulting in great improvement in operation efficiency.

In a preferred embodiment, the total numbers of the holders and rolls held on the holder trays and roll trays are at least the numbers of holders and rolls to be subjected to a smoking test of the smoking apparatus body for one day. Therefore, the smoking test can be continuously performed very efficiently all day without interrupting the jobs.

In a preferred embodiment, the arm of the robot apparatus comprises various hands for attaching tobacco rolls to the smoking mouths, for lighting a tobacco, etc. The hand for attaching tobacco rolls has a position detecting mechanism for measuring a position of the top end of the attached tobacco. To light the tobacco roll, the lighter hand is accurately brought into contact with the top end of the tobacco roll, thus assuring the lighting. Therefore, a reliable operation can be performed without failure in lighting.

It is preferable that the position measuring mechanism comprise an optical measuring device for optically detecting a length of a top end portion of a tobacco roll present in a predetermined measurement range in a state where the roll hand is stopped. The position of the top end of the tobacco roll is calculated from a stop position of the hand and the length of the top end portion of the tobacco roll.

Thus, since the hand need not be moved by the robot apparatus in measurement of the top end position of the tobacco roll, the measurement can be performed quickly. Further, the top end position of the tobacco roll can be detected accurately, less influenced by the control accuracy of the hand position of the robot apparatus or overshoot, as compared to the case where the top end of the tobacco roll is detected while the hand is moved, thereby detecting the top end position of the tobacco roll from the position of the hand.

Further, according to a preferred embodiment of the present invention, the robot apparatus lights the tobacco rolls attached to the plurality of smoking mouths successively from an end, and the robot apparatus comprises an infrared detector. The infrared detector detects infrared rays from a top end of a previous tobacco roll lighted before a tobacco roll which is being lighted, and detecting a temperature of the top end. Based on the temperature, it is detected whether the tobacco roll is normally lighted. If it is determined that the tobacco roll is not normally lighted, a re-lighting operation is performed. Therefore, even if the light of the tobacco roll goes out, the tobacco roll is automatically re-lighted, resulting in high reliability of the operation.

Further, according to a preferred embodiment of the present invention, a current flowing through the lighter hand for lighting tobacco rolls is monitored, and at least one spare lighter hand is provided in the operation range of the robot apparatus. If the heater of the lighter hand is broken, the breakage is detected and the lighter hand is automatically exchanged for the spare lighter hand. Thus, it is assured that an efficient operation is continuously performed without interruption by the breakage of the heater.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BEST MODE OF CARRYING OUT THE INVENTION

Figure 1:
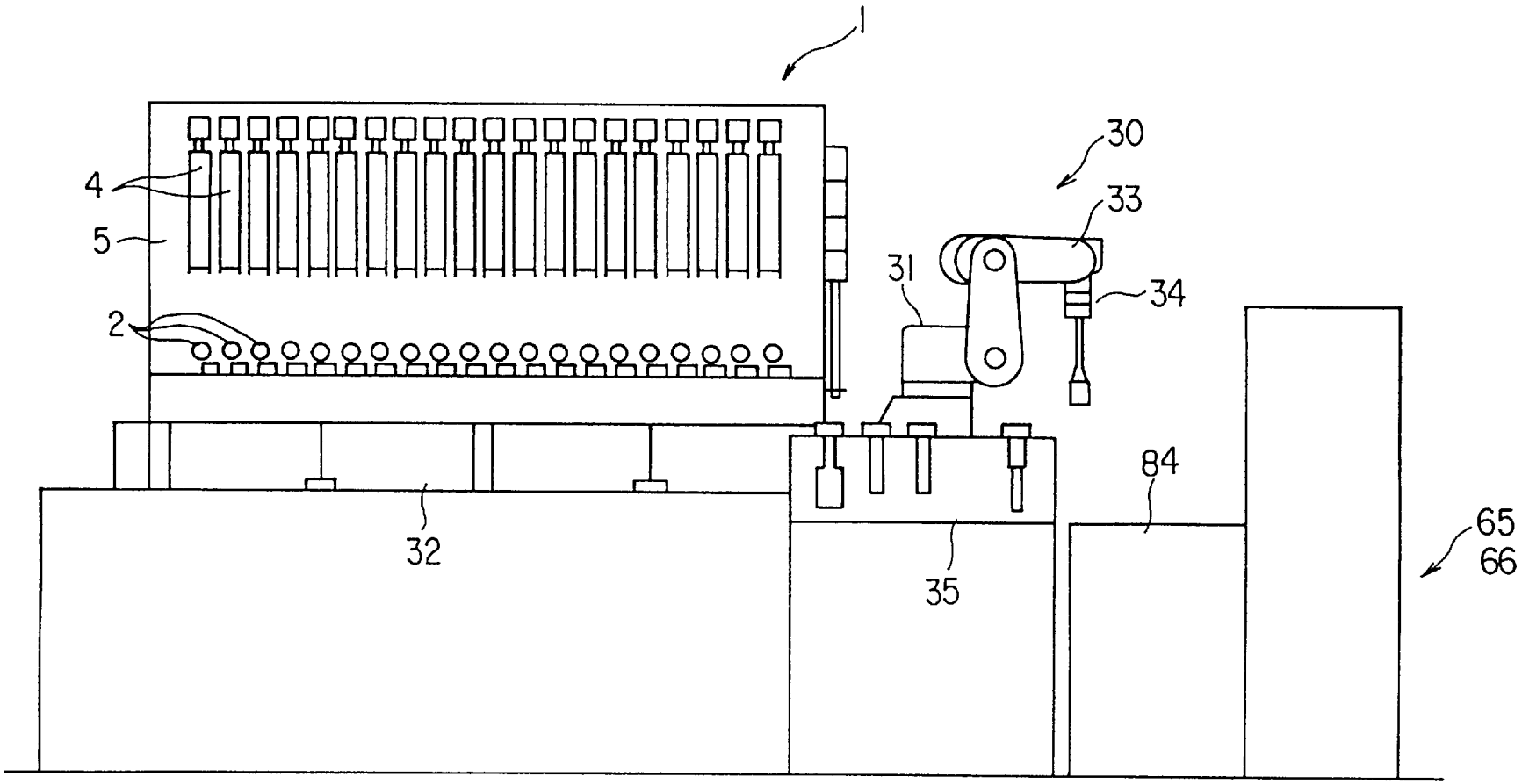
FIG. 1 is a front view of an automatic smoking machine as a whole according to an embodiment of the present invention.
Figure 2:
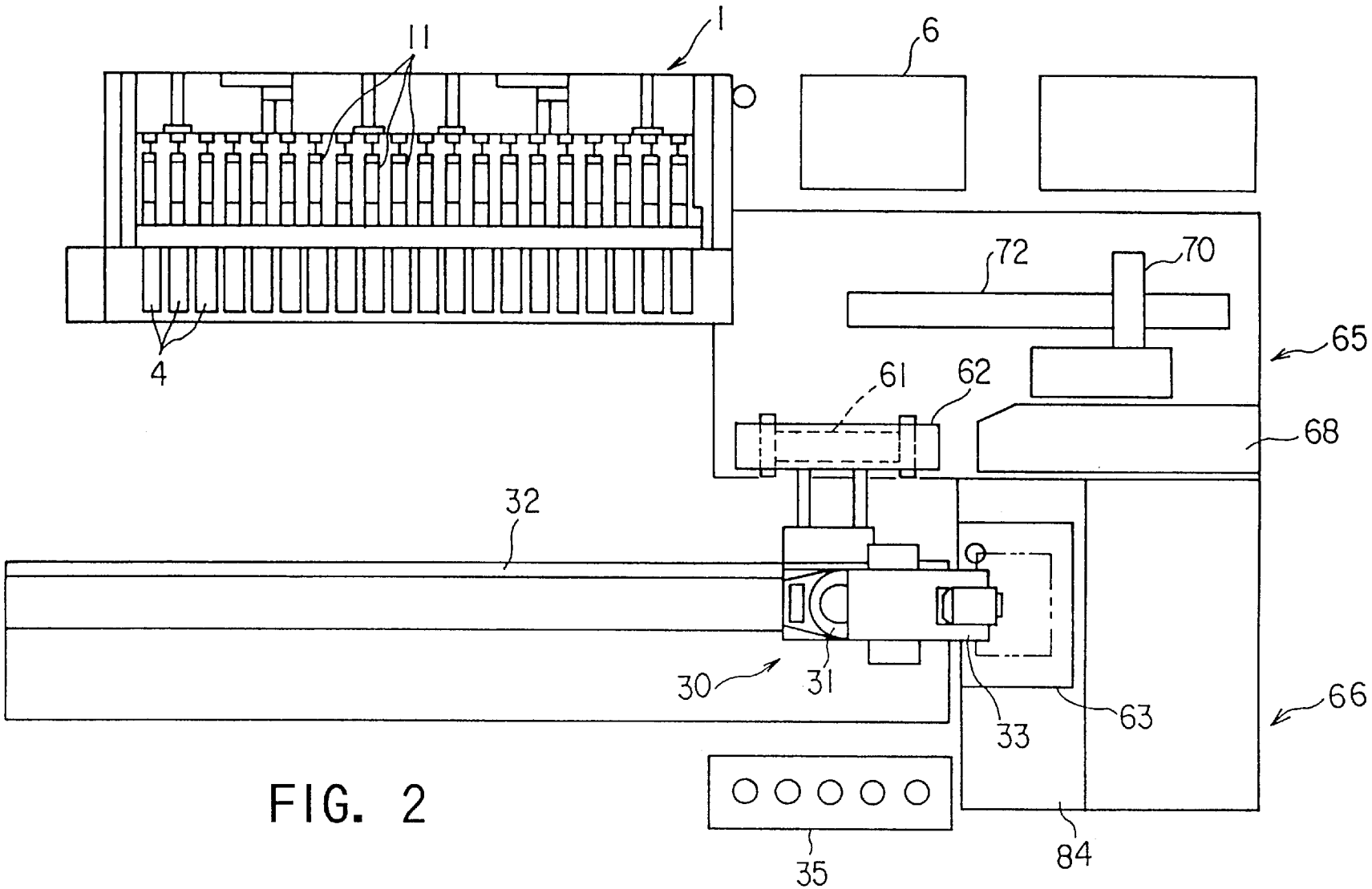
FIG. 2 is a plan view of the automatic smoking machine as a whole.
Figure 3:
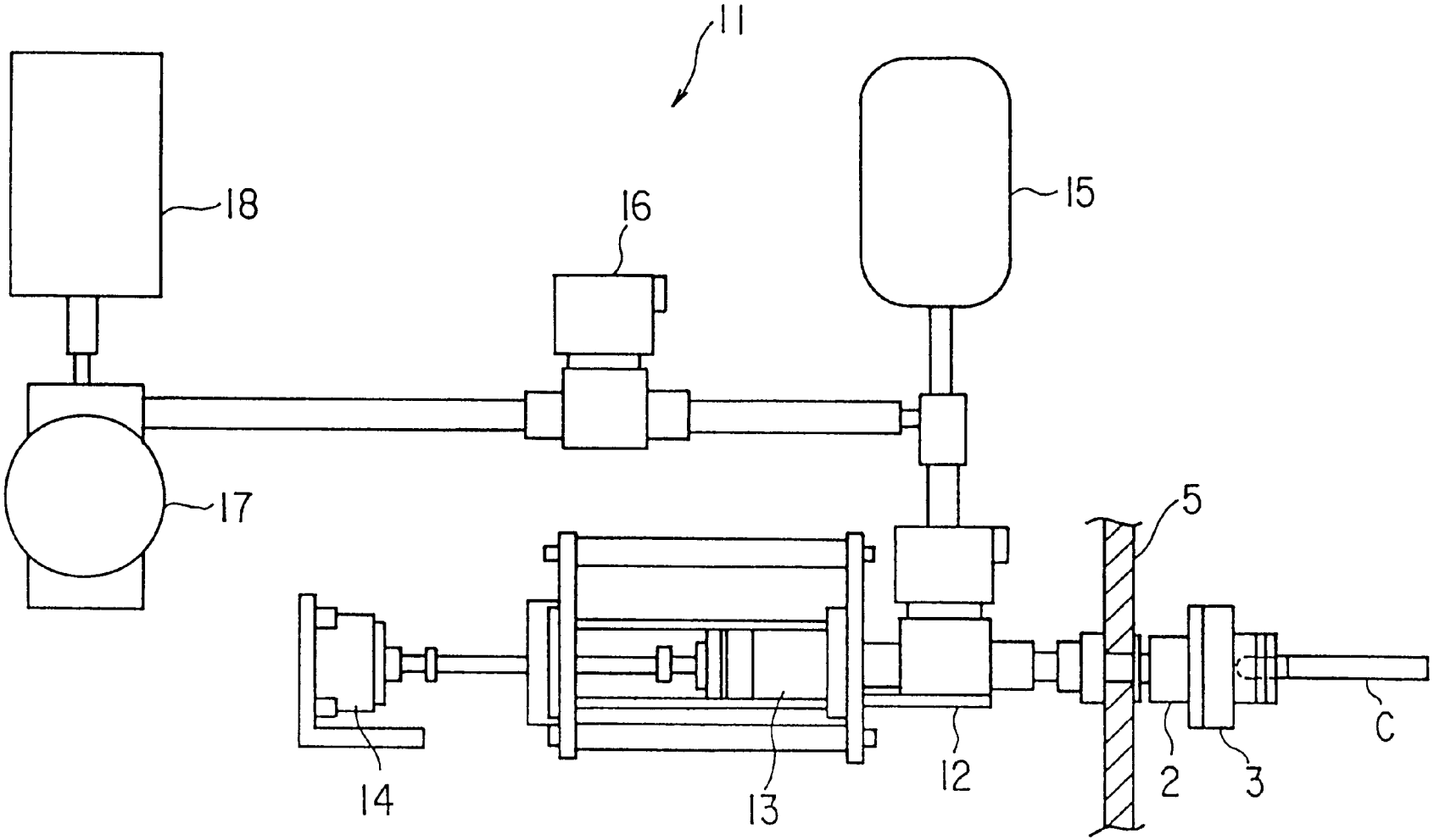
FIG. 3 is a cross-sectional view of a smoking mechanism portion of a smoking apparatus body.
Figure 4:
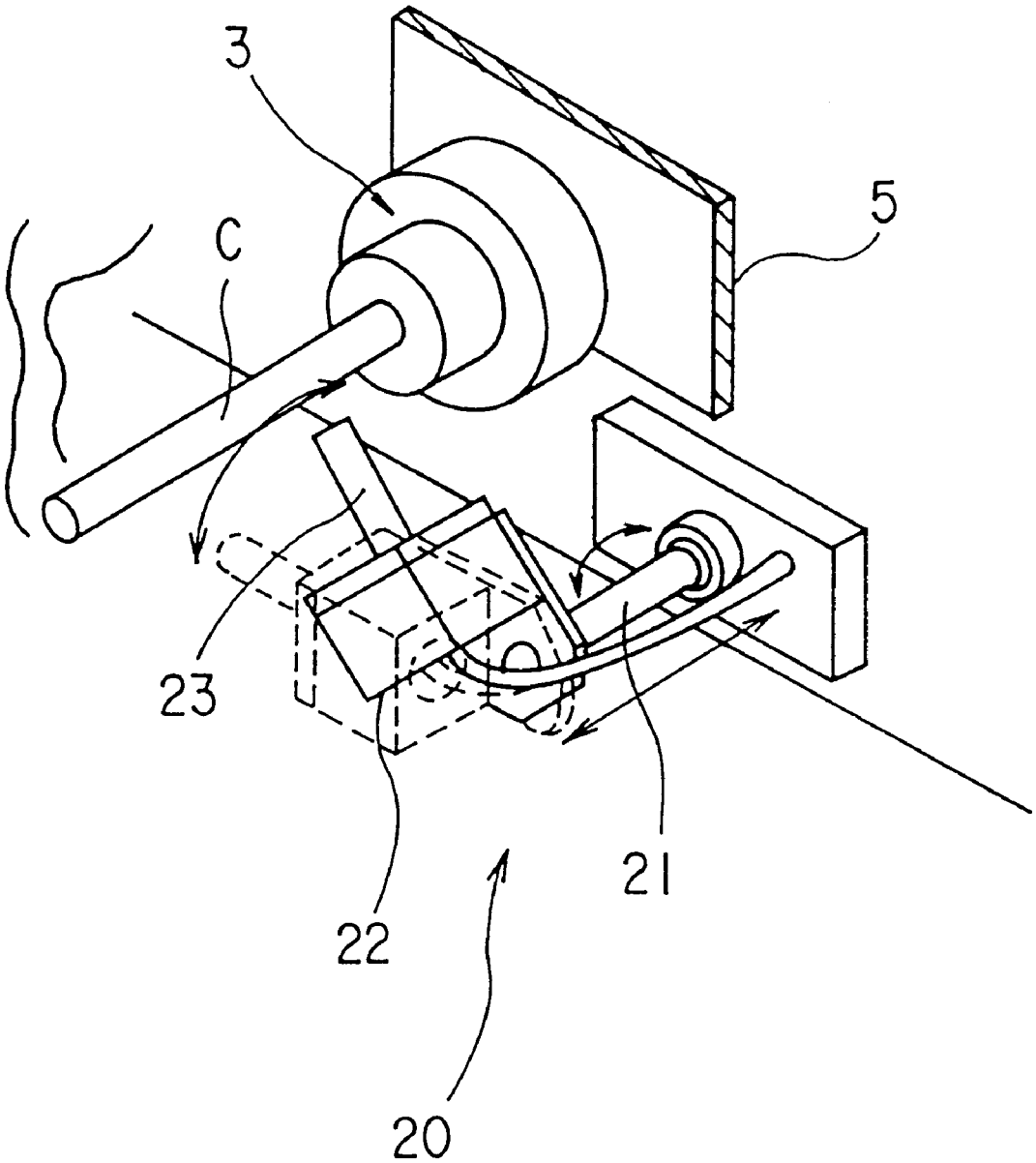
FIG. 4 is a perspective view of a smoking mouth portion of the smoking apparatus body.

An embodiment of the present invention will be described with reference to the drawings. The embodiment relates to an automatic smoking machine for automatically smoking rolls of tobacco such as cigarettes. First, the overall structure of the automatic smoking machine will be described with reference to FIGS. 1 to 4. FIG. 1 is a front view of the overall automatic smoking machine; FIG. 2 is a plan view thereof; FIG. 3 is a schematic side view of a smoking mechanism; and FIG. 4 is a perspective view of a smoking mouth portion.

In the drawings, a reference numeral 1 denotes a smoking apparatus body. A plurality of smoking mouths 2 are arranged in the horizontal direction on a front plate 5 of the smoking apparatus body 1. Holders 3 are attached to the smoking mouths 2, and rolls of tobacco C, such as cigarettes, are attached to the smoking mouths 2 via the holders 3.

In the smoking apparatus body 1, a smoking mechanism 11 as shown in FIG. 3 is provided to each of the smoking mouths 2. The smoking mechanism 11 comprises a cylinder mechanism 13, which communicates with the smoking mouth 2 and a smoke collecting bag 15 via a three-way valve 12. The cylinder mechanism 13 is reciprocated at predetermined cycles by a driving mechanism 14, while the three-way valve 12 is switched over in accordance with the operation of the cylinder mechanism 13. As a result, air is intermittently inhaled through the tobacco rolls via the holders 3, and the inhaled smoke, i.e., gas, is supplied to the collecting bag 15 via the three-way valve 12.

The collecting bag 15 is connected to a drawing pump 17 via a two-way valve 16, so that the smoke supplied to the collection bag 15 is drawn by the drawing pump 17. The smoke, or gas, is supplied to a gas analyzing apparatus 18, in which the components are analyzed. A Cambridge filter is incorporated in each holder 3, so that nicotine and tar in the smoke from the roll C are collected by the Cambridge filter.

A burn position detecting mechanism 20 as shown in FIG. 4 is provided near each smoking mouth 2 of the smoking apparatus body 1. An element 22 in the drawing is a head thereof, which is attached to a top end portion of a shaft 21. The shaft 21 is extended and retracted, and rotated in a predetermined angle by means of a driving mechanism (not shown). The head 22 incorporates an infrared detector to detect infrared rays from a burning portion of a tobacco roll C. A hood 23 is protruded from the head 22, so that infrared rays from directions other than a predetermined direction can be prevented from entering the infrared detector.

When a tobacco roll C is attached, the shaft 21 is extended to a predetermined position along an axial direction of the roll C, and the head 22 is returned to a predetermined burn stop position by a finger of the roll hand mounted to the robot apparatus. Then, the shaft 21 is rotated, so that the hood 23 of the head 22 is directed to the roll C. Therefore, when the roll C is burned to the burn stop position corresponding to the head 22, infrared rays from the burned portion are detected; that is, it is detected that the roll C has been burned to the predetermined position. In this case, the hood 23 cuts off the light other than the infrared rays from the burn position of the tobacco roll, thereby improving the accuracy in detection of the burn position.

In an upper front portion of the smoking apparatus 1, exhaustion hood mechanisms 4 are provided above the respective smoking mouths 2, to collect secondary flow smoke of the tobacco roll C and exhaust gas. The amount of exhaustion of the exhaustion hood mechanism 4 is adjusted such that the flow rate of air flowing around the tobacco roll C is kept at a predetermined value.

A robot apparatus 30 is provided on the front side of the smoking apparatus body 1. By means of the robot apparatus 30, the holders 3 and tobacco rolls C are automatically attached to the smoking mouths 2 and the attached rolls C are lighted. Further, when the rolls C are burned to the predetermined position, the burned portions in end portions of the rolls C are cut by the robot apparatus and the burning is stopped in accordance with a signal output from the burn position detecting mechanism 20. Thereafter, the stubs are removed by the robot apparatus.

The robot apparatus 30 is of a general-purpose type having a joint arm. A reference numeral 31 denotes a robot body. The robot body 31 is movable along a rail 32 provided in front of the smoking apparatus body 1, so that it can be located at positions corresponding to the respective smoking mouths 2.

The robot body 31 is provided with a joint arm 33. A hand attachment portion 34 is provided in a top end portion of the arm 33. A desirable hand corresponding to a job is detachably attached to the hand attachment portion 34: for example, a holder hand for picking up and attaching a holder 3 to the smoking mouth 2, a roll hand for picking up and attaching a tobacco roll to the holder 3, a cutter hand for cutting an end portion of the attached roll C which has been burned to the predetermined length, etc., can be attached.

All the operations of the automatic smoking machine, including the smoking apparatus body 1, the robot apparatus 30, etc., are controlled by a controller 6.

Figure 5:
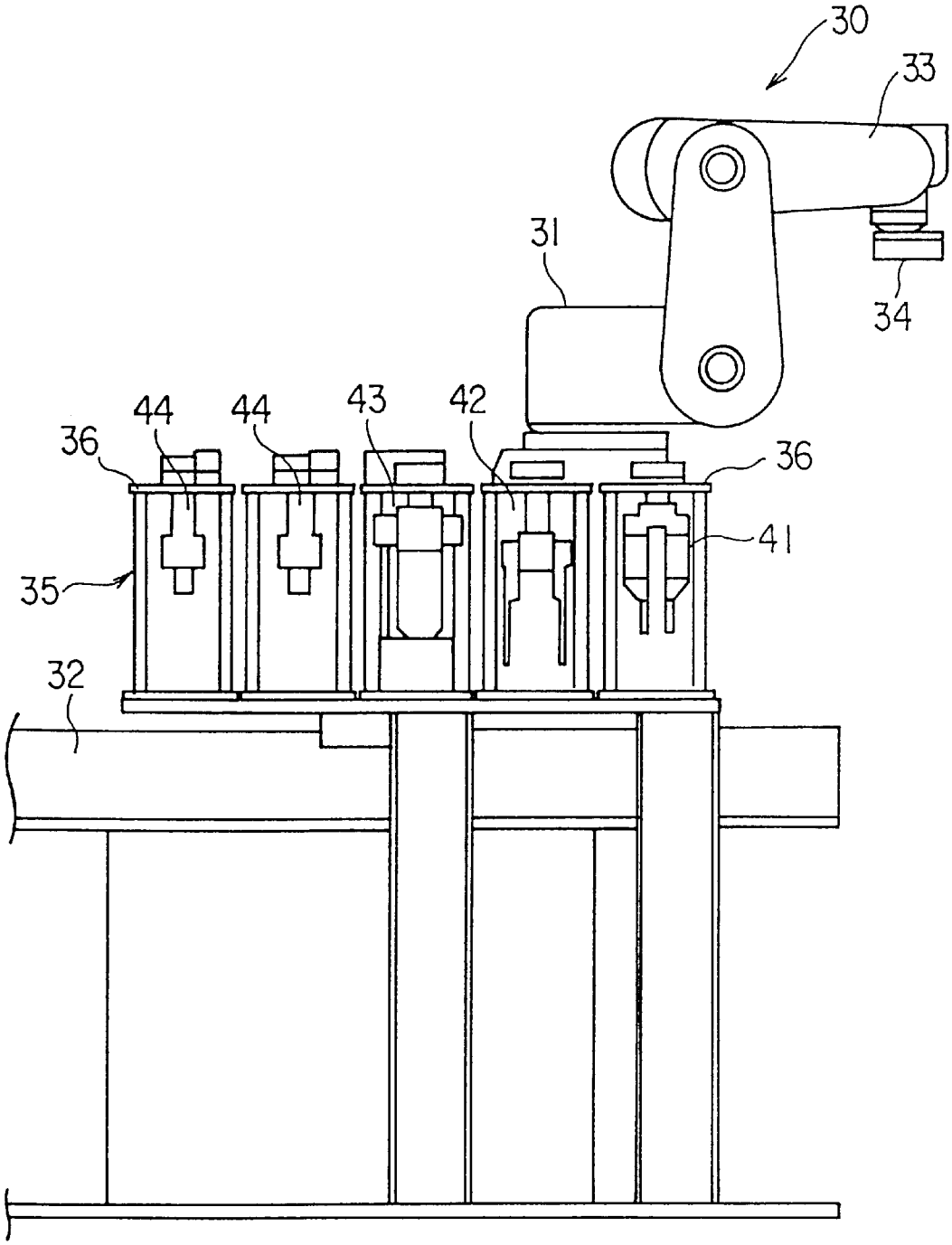
FIG. 5 is a front view of a robot apparatus and a mount portion on which various hands are mounted.
Figure 6:
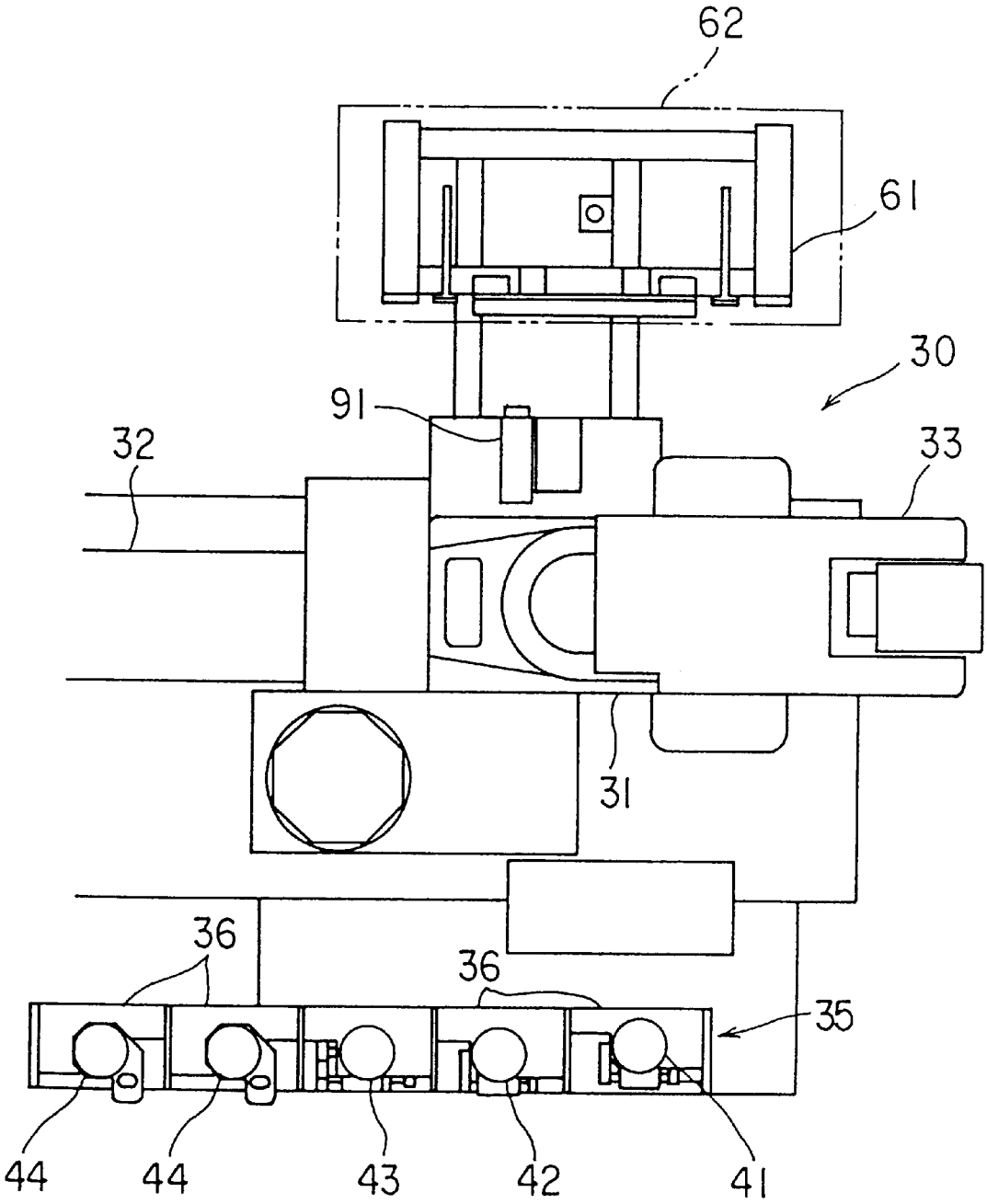
FIG. 6 is a plan view of the robot apparatus and the mount portion on which various hands are mounted.

The structure of a hand mount portion on which the hands are mounted will be described with reference to FIGS. 5 and 6. A hand mount portion 35 is located at an end portion of the rail 32 of the robot apparatus 30. Supporting plates 36 are mounted on the mount portion 35. Holding cuts of the shapes corresponding to the respective hands are formed in the supporting plates 36. There are five supporting plates 36, respectively holding a roll hand 41 for holding a tobacco roll C, a holder hand 42 for holding a holder 3, a cutter hand 43 for cutting an end portion of the tobacco roll C which has been burned to the predetermined position, and two lighter hands 44 for lighting the end portion of the tobacco roll C.

Figure 7:
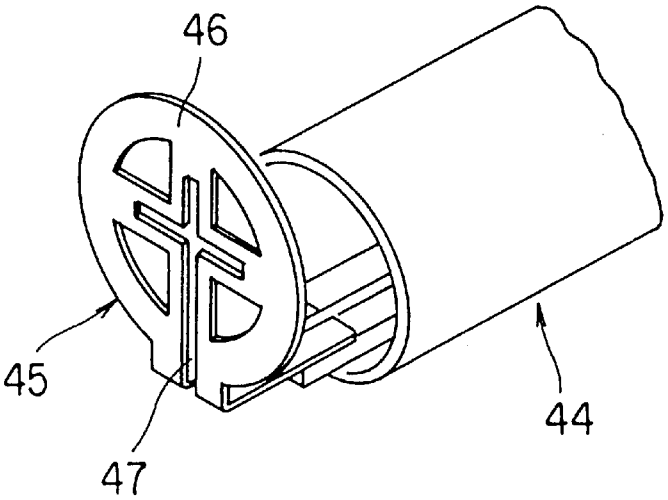
FIG. 7 is a perspective view of a part of a lighter hand.

The lighter hand 44 has a heater 45 as shown in FIG. 7 in its end portion. The heater 45 has a metal resistor plate 46 in which, for example, a cross-shaped cut portion 47 is formed. The heater 45 is heated by electricity. The heater 45 approaches the end of the attached tobacco roll C with a very small distance of about 1 mm, and lights the roll C. To assure lighting, the heater 45 is heated to a temperature of at least 600°, preferably 700° or higher.

The current value in case of turning on the heater is measured, and when the current value is lowered below a predetermined value, it is determined that the heater 45 is broken. A current-value measuring and determining circuit is incorporated in the controller 6. A plurality of lighters including a spare, for example, two lighter hands 44 are held on the mount portion 35. If the heater 45 of the lighter hand 44 is broken as described above, a spare lighter hand 44 is attached to the arm 33 of the robot apparatus 30.

Figure 8:
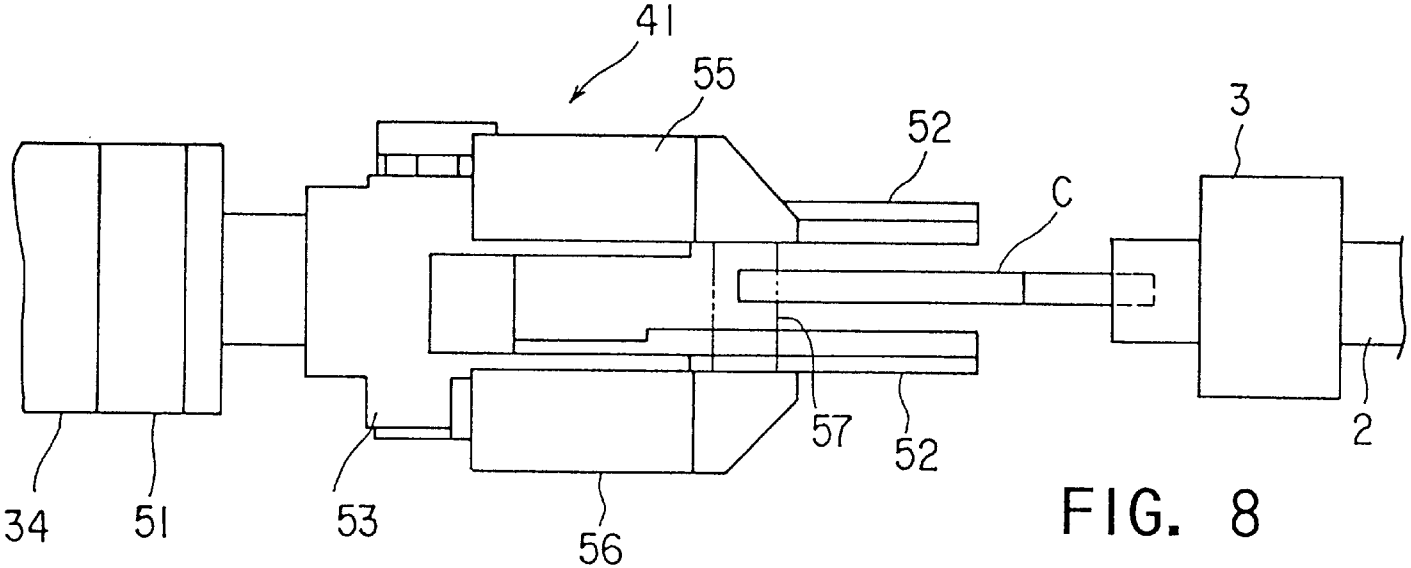
FIG. 8 is a plan view of a roll hand and a position detecting mechanism portion.

The structure of the roll hand 41 will now be described with reference to FIG. 8. The roll hand 41 comprises a socket 51 which is attached to the hand attachment portion 34 of the arm 33 of the robot apparatus 30. The roll hand 41 also comprises a pair of fingers 52, which are opened and closed by a driving mechanism 53, thereby holding the roll C, attaching the roll C to the holder attached to the smoking mouth 2, and holding and removing the stub of the roll C which has been burned to the predetermined position. The fingers 52 returns the head 22 of the burn position detecting mechanism 20 to the burn stop position.

Further, the roll hand 41 comprises a position detecting mechanism for detecting the position of the end of the attached tobacco C. The position detecting mechanism comprises a light emitter 55 and a light receiver 56. The light emitter 55 and the light receiver 56 are fixed to a member on the fixed side, independent of the fingers 52, and face each other with a predetermined distance. A belt-like laser beam 57, having a predetermined width corresponding to a predetermined measurement range, is emitted from the light emitter 55 and received by the light receiver 56.

The width direction of the belt-like laser beam 57 coincides with the length direction of the attached tobacco roll C. When the end of the roll C is located in the width of the belt-like laser beam 57, part of the laser beam 57 is blocked off by the end portion of the tobacco roll C. The light receiver 56 measures the length of a portion blocked off by the end portion of the roll C from the amount of the received laser beam 57, thereby measuring the position of the end of the roll C.

The brand and length of a tobacco roll to be smoked are registered in the controller 6 in advance. The robot apparatus 30 is controlled in accordance with the length of the roll C, and the roll hand 41 is stopped at a predetermined position where the end of the roll C is located in the width of the laser beam 57, i.e., the predetermined measurement range. Therefore, the position of the end of the roll C can be measured accurately by measuring the length of the end portion of the roll C, which blocks off the laser beam 57, by means of the position detecting mechanism.

Figure 9:
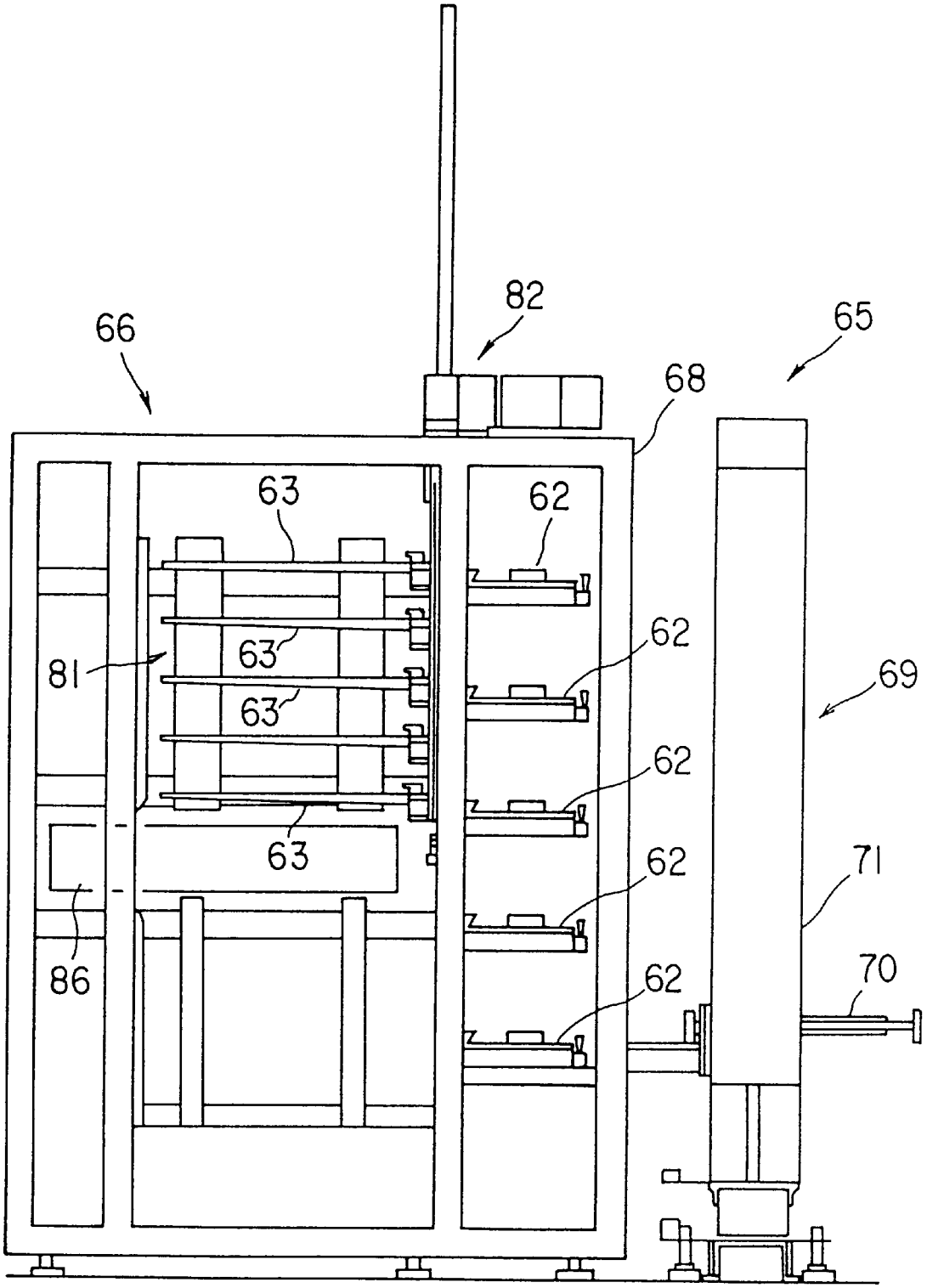
FIG. 9 is a side view of a roll tray supplying mechanism and a holder tray supplying mechanism.
Figure 10:
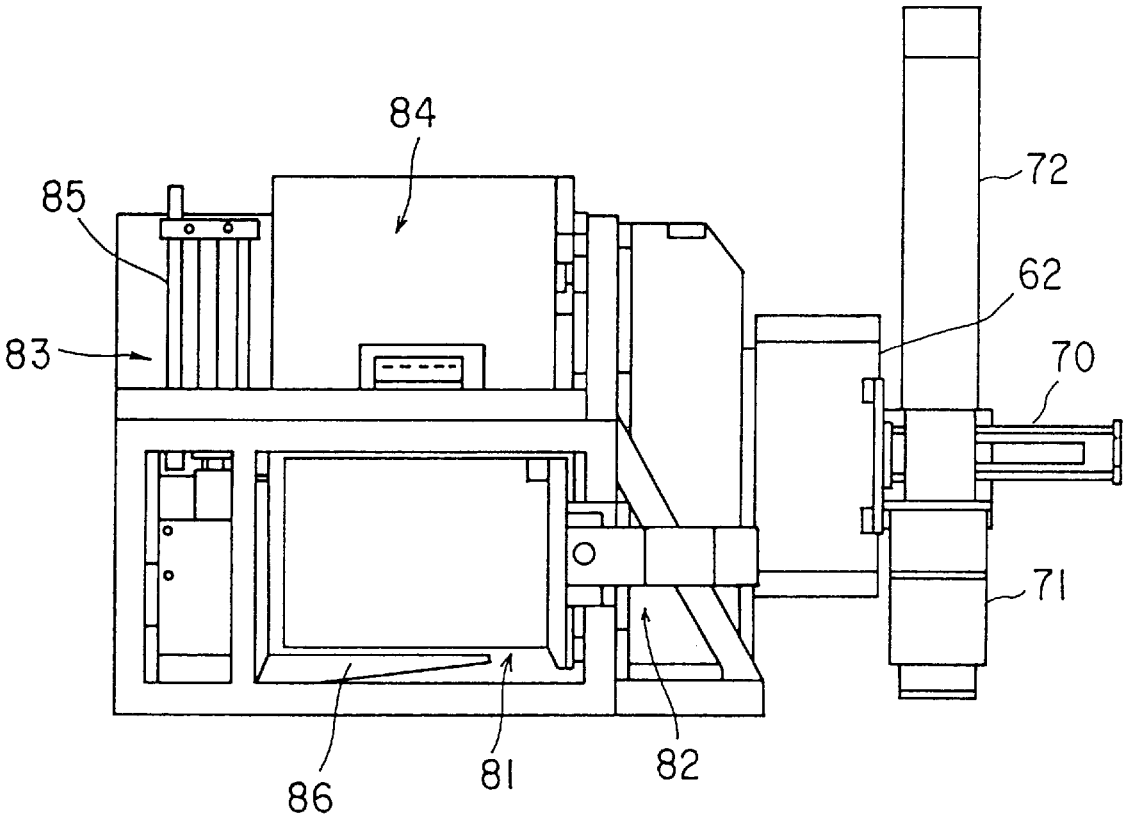
FIG. 10 is a plan view of the roll tray supplying mechanism and the holder tray supplying mechanism.
Figure 11:
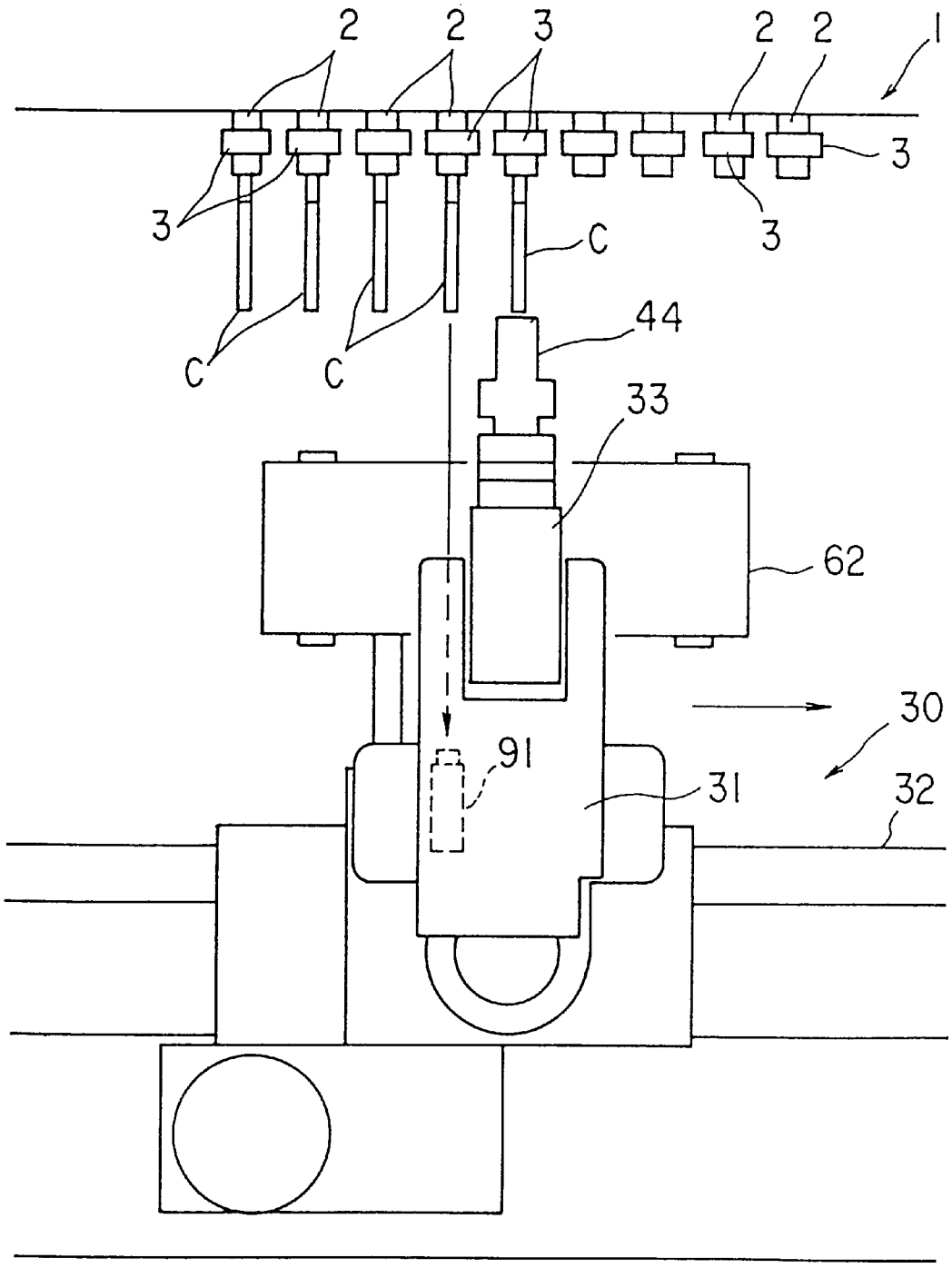
FIG. 11 is a plan view of a robot main body and a lighting defect detecting mechanism portion.

An apparatus for supplying the holders 3 and the tobacco rolls C will be described with reference to FIGS. 6, 9 and 11. In this embodiment, the smoking apparatus body 1 has twenty smoking mouths 2, to which the holders 3 are respectively attached. A plurality of tobacco rolls C are attached to each of the holders 3 and smoked; that is, each holder 3 collects nicotine and tar of a plurality of rolls C.

A roll tray holder 61 is projected from a lower portion of the robot body 31. A roll tray 62 is placed on the roll tray holder 61, and a plurality of tobacco rolls C are placed on the roll tray 62. The number of tobacco rolls coincides with the total number of tobacco rolls attached to the twenty holders attached to the twenty smoking mouths 2 of the smoking apparatus body 1.

The roll tray 62 held by the roll tray holder 61 is moved along with the robot body 31. The roll hand 41 at the end of the arm 33 of the robot apparatus catches rolls C on the roll tray 62, and sequentially supplies them to the holders 3 of the respective smoking mouths 2.

The holders 3 of the number corresponding to the number of smoking mouths 2, i.e., twenty holders, are placed on a holder tray 63 located at an end portion of the rail 32 of the robot apparatus 30. When the burning test of all the rolls C on the roll tray 62 is completed, the roll hand 41 at the top end of the arm 33 of the robot apparatus 30 is exchanged for the holder hand 42. The holders 3 which have collected tar are successively removed from the smoking mouths 2 by the holder hand 42. Each time the holder is removed, the robot body 31 is moved toward the end portion of the rail 32 and returns the holder 3 to the holder tray 63.

A roll tray supplying mechanism 65 for successively supplying the roll trays 62 and a holder tray supplying mechanism 66 for successively supplying the holder trays 63 are arranged at the end portion of the rail 32 of the robot apparatus 30.

The roll tray supplying mechanism 65 is constructed as follows. A reference numeral 68 denotes a roll tray rack, which has five shelves. Five roll trays 62 are held in the roll tray rack 68 one on another with a distance therebetween. The roll trays 62 can be drawn out of a side portion of the roll tray rack 68.

A roll tray drawing mechanism 69 is arranged beside the roll tray rack 68. The roll tray drawing mechanism 69 comprises a roll tray carrier 70 for drawing and holding the roll tray 62 from the roll tray rack 68. It also comprises an elevating mechanism 71 for moving up and down the roll tray carrier 70 and a horizontal movement mechanism 72 for moving the roll tray carrier 70 in horizontal directions.

The roll tray carrier 70 is moved up by the elevating mechanism 71, and draws and holds the roll tray 62 from any stage of the roll tray rack 68. Then, the roll tray carrier 70 is moved down by the elevating mechanism 71. The roll tray carrier 70 is moved horizontally by the horizontal movement mechanism 72 in parallel with the rail 32 of the robot apparatus 30, while holding the roll tray 62. The roll tray 62 is transferred to the roll tray holder 61 of the robot body 31 which has been moved to the end portion of the rail 32.

The holder tray supplying mechanism 66 is constructed as follows. A reference numeral 81 denotes an elevating rack. The elevating rack 81 holds five holder trays 63 one on another with a distance therebetween, and moved up and down as a whole, while holding the holder trays 63. A reference numeral 82 denotes an elevating mechanism for moving up and down the elevating rack 81. A holder tray mount 84 is arranged opposite to the end portion of the rail 32 of the robot apparatus 30. A holder tray movement mechanism 83 is arranged beside the holder tray mount 84. The holder tray movement mechanism 83 comprises a pressing plate 86 and an air cylinder mechanism 85 for moving it in horizontal directions. When the elevating rack 81 is moved up or down and any holder tray 63 is located at the same height as the holder tray mount 84, the holder tray movement mechanism 83 is operated, so that the pressing plate 86 is moved forward to press the holder tray 63 onto the holder rack mount 84.

The operations of the portions of the roll tray supplying mechanism 65 and the holder tray supplying mechanism 66 are controlled by the controller 6.

The robot body 31 comprises a lighting defect detecting mechanism for detecting a lighting defect of the tobacco rolls C attached to the smoking apparatus body 1. The lighting defect detecting mechanism comprises an infrared detector 91, which is mounted in the robot body 31. The infrared detector 91 is directed to the tobacco roll C attached to the smoking apparatus body 1, as shown in FIG. 11, and constructed so that, when the lighter hand 44 is lighting a tobacco roll C attached to the top end portion of the arm 33 of the robot body 31, the detector 91 is directed to a previous tobacco roll C, one before the tobacco roll C which is lighted, and detects infrared rays from the end of the previous tobacco roll C.

The infrared detector 91 outputs a control signal, which is supplied to the controller 6, so that, if the level of the infrared rays from the previous roll C is lower than a predetermined level, it is judged that the lighting of the previous roll C is defective, and a re-lighting operation can be performed.

The operations of the overall automatic smoking machine of the above embodiment will now be described in sequence. First, prior to starting the operation of the automatic smoking machine, five roll trays 62 are placed on the roll tray rack 68 of the roll tray supplying mechanism 65, and five holder trays 63 are attached to the elevating rack 81 of the holder tray supplying mechanism 66.

As described above, each holder tray 63 holds twenty holders 3 to be attached to the smoking mouths 2 of the smoking apparatus body 1. A plurality of tobacco rolls C are attached to one holder and subjected to a smoking test, and the roll tray 62 holds tobacco rolls C of the number corresponding to the total number of rolls C to be attached to the holders. In this embodiment, it takes about two hours to attach the holders to the twenty smoking mouths 2 and a number of rolls C to each holder 3, and perform a smoking test of the rolls C.

Therefore, the holders and rolls for 2×5=10 hours can be loaded using five holder trays 63 and five roll trays 62; that is, the holders and rolls for one day can be loaded by one operation. For this reason, if the five holder trays 63 and five roll trays 62 are loaded at the beginning of the jobs of a day, a worker need not enter the operation range of the robot apparatus 30. Therefore, the automatic smoking machine can be operated all day long without interrupting the operation.

After the holder trays 63 and roll trays 62 are loaded, an automatic operation of the automatic smoking machine is started. First, the elevating rack 81 of the holder tray supplying mechanism 66 is moved up and down, and the holder tray movement mechanism 83 is operated, so that a first holder tray 63 is supplied to the holder tray mount portion 84. At the same time, the roll tray carrier 70 is moved up by the elevating mechanism 71, draws and holds a first roll tray 62 from the roll tray rack 68, moved by the elevating mechanism 71 and the horizontal movement mechanism 72, and moved to the top end portion of the horizontal movement mechanism 72.

Next, the robot body 31, which has been moved to the end portion of the rail 32, receives the roll tray 62 on the roll tray carrier 70 of the roll tray supplying mechanism 65, and places it on the roll tray holder 61 of the robot body 31.

After the transfer of the roll tray 62 is completed, the roll tray carrier 70 is moved horizontally on the horizontal movement mechanism 72 and returned. Then, the robot body 31 of the robot apparatus 30 is moved to the position of the mount portion 35 along the rail 32, and the holder hand 42 is attached to the hand attachment portion 34 at the top end of the arm 33.

Subsequently, the robot body 31 is moved to the end portion of the rail 32, and picks up one of the holders 3 from the holder tray 63 on the holder tray mount 84. Then, the robot body 31 is moved to the position of the smoking mouth 2 at an end of the smoking apparatus body 1, attaches the picked-up holder 3 to the smoking mouth 2. The operations described above are repeated, so that the holders 3 are successively attached to the respective smoking mouths 2 of the smoking apparatus body 1.

Then, the robot body 31 is moved to the position of the mount portion 35 on which various hands are mounted, and the holder hand 42 is removed from the top end of the arm 33 and placed at a predetermined position of the mount portion 35. At the same time, the roll hand 41 is attached afresh to the top end portion of the arm 33.

Subsequently, the robot body 31 is moved along the rail 32 to the initial position of the smoking mouth 2 to which the roll is to be attached, while holding the roll tray 62. The roll C on the roll tray 62 is picked up and attached to the holder 3 attached to the smoking mouth 2 by means of the roll hand 41 at the top end of the arm 33 of the robot body 31. When the attachment of the roll C is completed, the roll hand 41 releases the roll C, and is moved to a predetermined position corresponding to the end of the attached roll C along the axial direction, in accordance with the data on the roll C, such as the brand, stored in the controller 6. Then, the roll hand 41 is stopped.

In this state, as described before, a belt-like laser beam is emitted in a predetermined range from the Light emitter 55 of the position detecting mechanism mounted on the roll hand 41. The laser beam is received by the light receiver 56. In this case, part of the laser beam is blocked off by the end portion of the attached tobacco roll C. The light receiver 56 measures the length of the portion blocked off by the end portion of the attached roll C. As a result, the position of the end of the attached roll C is measured accurately, and data on the position of the end of each roll C is stored individually in the controller 6.

The controller 6 calculates a burn stop position of the roll C based on the stored brand data of the tobacco roll C from the length of the roll C to be burned and the top end position of the roll C, and feeds back the signal to the robot body 31. The robot body 31 moves the hand 41 based on the feedback signal, and presses the head 22 of the burn position detecting mechanism 20 to the predetermined burn stop position, as described before.

The aforementioned measurement of the end position of the tobacco roll C is efficient, since the hand 41 need not be moved. According to the generally employed measurement, the end of a tobacco roll is detected by an optical detector, while the hand 41 is being moved, and the end position of the tobacco roll is measured from the position of the hand when the end of the tobacco roll is detected. In this measurement, an error may arise in the accuracy of the end position of the tobacco roll, depending on an error in the control accuracy of the hand position of the robot apparatus, overshoot, etc. However, as described above, if the length of the end portion of a tobacco roll C located in the predetermined range is optically measured in the state where the hand 41 is stopped, it is possible to perform accurate measurement, not influenced by the aforementioned error.

The robot body 31 repeats the above operations, while moving along the rail 32, and successively attaches the rolls C to the holders 3 of the smoking mouths 2. In this case, since the rolls C are picked up from the roll tray 62 which is held by and moves along the robot body 31, it is only necessary for the robot body 31 to successively move to face the respective smoking mouths 2 from its end, resulting in reduction of time required for attachment of the rolls C.

When the attachment of the rolls C is completed, the robot body 31 is moved to the position of the hand mount portion 35, and the roll hand 41 at the end portion of the arm 33 is exchanged for the lighter hand 44. Then, while moving along the rail 32, the robot body 31 successively lights the ends of the attached rolls C.

In this case, in the lighter hand 44, the heater 45 faces the end of the roll C with a very small distance of about 1 mm. In this state, the smoking apparatus body 1 inhales air through the roll C, thereby lighting the roll C. In this case, as described before, since the position of the end of the roll C is accurately detected and stored in the memory, when the roll C is attached, the heater 45 can approach the end of the roll C very closely, and light it without failure. Further, it is assured that interference of the heater 45 with the end of the roll C and dislocation of the roll C are prevented.

In the lighting operation, the value of the current flowing through the heater 45, etc., is controlled by the controller 6, so that the heater 45 can be maintained at a predetermined temperature. In addition, the value of the current to the heater 45 is monitored at all times by the controller 6. When the current value is lower than a predetermined value, it is determined that the heater 45 of the lighter hand 44 is broken.

In this case, the controller 6 causes the robot body 31 to move to the position of the hand mount portion 35 and exchange the broken lighter hand 44 for the spare lighter hand 44, so that the aforementioned lighting operation is continued. Thus, it is possible to perform a reliable test, without interruption of the lighting operation or smoking test by the breakage of the lighter hand. In addition, since the lighting operation or smoking test will not be interfered with even if the heater 45 of the lighter hand 44 is broken, the temperature of the heater 45 of the lighter hand 44 can be set to 600° or higher, preferably 700° or higher, as described above, and the lighting of the rolls C can be more assured.

Further, to make the lighting of the rolls C more assured, the lighting of the roll C is confirmed by the lighting defect detecting mechanism. More specifically, the infrared detector 91 of the lighting defect detecting mechanism is attached to the robot body 31 as described above, and the infrared detector 91 is constructed to detect infrared rays from the top end of the previous roll C, one before the roll C which is being lighted by the lighter hand 44 at the end of the arm 33. A signal from the infrared detector 91 is transmitted to the controller 6, and the temperature of the top end portion of the roll C is measured on the basis of the amount of light and spectral distribution of the infrared rays from the top end of the roll C. If the temperature is lower than the predetermined set value, for example, by 50° C. or more lower than the temperature of the normally-lighted roll, it is determined that the lighting of the roll C has failed.

The controller 6 stores the position of the roll C on which lighting was failed. After the lighting operation of all the rolls C is completed, the robot body 31 is returned to the position of the roll C on which lighting was failed, and lights the roll again.

Since the roll C is lighted by drawing air through the roll C in the state where the heater 45 of the lighter hand 44 is close to the end of the roll C, the roll C may not be lighted or may go out after it is lighted, depending on the circumstances. Even in those cases, since infrared rays from the top end portion of the previous roll C, which has been left for a predetermined period of time after lighting, are detected by the infrared detector 91, the failure of the lighting of the roll C can be assuredly detected. Therefore, it is possible to surely avoid reperformance of the overall smoking test by the failure of the lighting.

After the rolls C of the respective smoking mouths 2 are lighted as described above, the smoking apparatus body 1 performs predetermined smoking test operations as described before, to measure the number of puffs and the burning speed of each roll and analyze the components.

Further, the robot body 31 is moved to the position of the mount portion 35, exchanges the lighter hand 44 at the end of the arm 33 for the cutter hand 43, and stands by until the completion of the burning of the roll C. When each roll is burned to the predetermined burn end position, infrared rays are detected by the head 22 of the burn position detecting mechanism 20 of the smoking apparatus body 1, thereby detecting that the roll C is burned to the predetermined position. The signal is transmitted to the controller 6, which transmits a control signal to the robot apparatus 30. Then, the robot body 31 is moved to the position of the roll C which has been burned to the predetermined position, and cuts the end portion of the roll C with the cutter hand 43 to extinguish the light.

The above operations are repeated, the end portions of the rolls C which have been burned are cut to extinguish the light, and the stubs, etc., are removed. In this case, the setting of the head 22 to the burn stop position and the cutting of the end portion of the roll C by the cutter hand 43 are performed on the basis of detection data on the position of the roll end portion detected by the position detecting mechanism of the roll hand 41. Therefore, the burning can be stopped and cut and extinguishment can be performed at accurate positions.

When the smoking test is completed for all the rolls C, the robot apparatus 30 performs again a series of operations again: attachment of rolls C to the holders 3 of the smoking mouths 2, lighting of the rolls, the smoking test, cutting and extinguishment, etc. When the smoking test is completed for a predetermined number of rolls for one holder 3, the holder hand 42 is attached again to the arm 33 of the robot body 31, and the holders 3 are removed from the smoking mouths 2 and returned to the holder tray 63. Further, the holder tray 63 is returned to the rack 81 and transferred to a process of analyzing the collected tar. At the same time, the empty roll tray 62 held by the robot body 31 is returned to the roll tray rack 68.

The smoking test is returned to the initial state, and the robot body 31 is moved to the end of the rail 32, picks up holders 3 from the next holder tray 63 on the holder tray mount 84 of the holder tray supplying mechanism 66, and attaches them to the smoking mouths 2. Then, the aforementioned serial smoking test is started. As described before, the holder tray supplying mechanism 66 and the roll tray supplying mechanism 65 include five holder trays and five roll trays respectively, and it takes two hours to perform a smoking test for the holders and rolls on each holder tray and roll tray. Therefore, a worker need not enter the radius of operation of the robot apparatus 30 for ten hours, so that the smoking test can be performed automatically all day long without interruption.

The present invention is not limited to the above embodiment. For example, the type of the robot apparatus is not limited to that of the above embodiment, but another type of robot apparatus can be used. In this case, the holder tray supplying mechanism and the roll tray supplying mechanism need not be arranged near the end portion of the rail of the robot apparatus. It is only necessary that the holder trays and roll trays are consecutively supplied one by one to the operation range of the robot apparatus.

Further, the holder tray supplying mechanism and the roll tray supplying mechanisms are not limited to the above structures. For example, the holder trays and roll trays need not be held in racks, arranged one on another. If there is an enough room for the automatic smoking machine, a plurality of holder trays and roll trays may be held on a horizontal conveyor or a turn table.

Furthermore, the number of holder trays or roll trays held in the holder tray supplying mechanism or roll tray supplying mechanism is not limited to that of the above embodiment. Moreover, the supplied roll tray may not be necessarily held by the robot body or moved along with the robot body. Contrarily, the holder tray may be held by the robot body together with the roll tray.

As has been described above, the present invention provides the following advantages: since holders and tobacco rolls are automatically supplied, the automatic operation can be performed continuously for a long period of time; and since a worker need not enter the operation range of the robot apparatus, it is unnecessary to stop the operation of the robot apparatus, resulting in a high efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic smoking machine comprising: a smoking apparatus body; a plurality of smoking mouths arranged on a front surface of the smoking apparatus body; and a robot apparatus, arranged in front of the smoking apparatus body, for attaching holders and tobacco rolls to the smoking mouths and lighting the tobacco rolls, wherein:

the robot apparatus comprises: a rail extending along a direction of arrangement of the smoking mouths on the front surface of the smoking apparatus; a robot body movable along the rail; a roll hand for attaching the tobacco rolls to the smoking mouths and a lighter hand for lighting a top end of an attached tobacco roll, the roll hand having a position detecting mechanism for measuring a position of the top end of the attached tobacco roll, said position measuring mechanism including an optical measuring device, provided in the roll hand, for optically detecting a length of a top end portion of a tobacco roll present in a predetermined measurement range in a state where the roll hand is stopped near the top end portion of the tobacco roll attached to the smoking mouth; and a controller for receiving a signal from the optical measuring device and the robot apparatus and calculating a position of the top end of the tobacco roll from a stop position of the robot apparatus and the length of the top end portion of the tobacco roll present in the predetermined range measured by the optical measuring device, said controller prestores lengths of tobacco rolls corresponding to a plurality of brands of tobacco rolls, calculates a rough position of the top end of the attached tobacco roll in accordance with the brand thereof, and controls the stop position of the hand of the robot apparatus, so that the top end of the tobacco roll is located within the measurement range of the optical measuring device; and a holder tray supplying mechanism and a roll tray supplying mechanism are provided near an end portion of the rail, the holder tray supplying mechanism and the roll tray supplying mechanism holding a plurality of holder trays and roll trays, respectively, the holder trays and roll trays being supplied one by one to an operation range of the robot body, and each of the holder trays and roll trays holding a plurality of holders and tobacco rolls, respectively.

2. A holder and roll supplying apparatus of the automatic smoking machine according to claim 1, wherein total numbers of the plurality of holders and rolls held on the plurality of holder trays and roll trays are at least numbers of holders and rolls to be subjected to a smoking test of the smoking apparatus body for one day.

3. The automatic smoking machine according to claim 1, wherein:

a number of holders held on one holder tray is equal to a number of smoking mouths on the smoking apparatus body;

a number of tobacco rolls held by the roll tray is equal to a total number of tobacco rolls attached to the holders and subjected to a smoking test, a plurality of tobacco rolls being attached to each holder; and a roll tray holder is provided in the robot body, the roll trays supplied from the roll tray supplying mechanism being held on the roll tray holder, so that the roll trays move along with the robot body.

4. The automatic smoking machine according to claim 1, wherein the optical measuring device is a parallel beam sensor for emitting parallel beams to the measurement range and detecting a length of the top end portion of the tobacco roll which blocks off the parallel beams, thereby measuring the length of the top end portion of the tobacco roll present in the measurement range.

5. An automatic smoking machine, comprising: a smoking apparatus body; a plurality of smoking mouths arranged on a front surface of the smoking apparatus body; and a robot apparatus, arranged in front of the smoking apparatus body, for attaching holders and tobacco rolls to the smoking mouths and lighting the tobacco rolls, wherein:

the robot apparatus comprises: a rail extending along a direction of arrangement of the smoking mouths on the front surface of the smoking apparatus; a robot body movable along the rail, wherein the robot apparatus lights the tobacco rolls attached to the plurality of smoking mouths successively from an end; an infrared detector for detecting infrared rays from a top end of a previous tobacco roll lighted before a tobacco roll which is being lighted by the robot apparatus, and detecting a temperature of the top end; and a controller for receiving a signal from the infrared detector, determining that lighting of the previous tobacco is defective, if the temperature of the top end of the previous tobacco roll is lower than a temperature in a case of a normally-lighted state, and outputting a signal for re-lighting the previous tobacco roll to the robot apparatus; and a holder tray supplying mechanism and a roll tray supplying mechanism are provided near an end portion of the rail, the holder tray supplying mechanism and the roll tray supplying mechanism holding a plurality of holder trays and roll trays, respectively, the holder trays and roll trays being supplied one by one to an operation range of the robot body, and each of the holder trays and roll trays holding a plurality of holders and tobacco rolls, respectively.

6. The automatic smoking machine according to claim 5, wherein the infrared detector is attached to a position deviated from an axis of the arm of the robot body, and directed to the top end of the previous tobacco roll lighted before the tobacco roll which is being lighted by the lighter hand at an end of the arm.

7. The automatic smoking machine according to claim 5, wherein the controller stores a position of the tobacco roll determined as being a light-defect roll based on the signal from the infrared detector, and outputs a signal for re-lighting the tobacco roll at the stored position to the robot apparatus, after all tobacco rolls attached to the smoking mouths are lighted.

8. An automatic smoking machine, comprising: a smoking apparatus body; a plurality of smoking mouths arranged on a front surface of the smoking apparatus body; and a robot apparatus, arranged in front of the smoking apparatus body, for attaching holders and tobacco rolls to the smoking mouths and lighting the tobacco rolls, wherein:

the robot apparatus comprises: a rail extending along a direction of arrangement of the smoking mouths on the front surface of the smoking apparatus; a robot body movable along the rail;

a lighter hand for lighting a top end of an attached tobacco roll is detachably attached to the robot apparatus, the lighter hand having a heater for lighting the top end of the tobacco roll;

at least one spare lighter hand is provided in an operation range of the robot apparatus; and the robot apparatus further comprises a controller for monitoring a current flowing through the heater of the lighter hand attached to the robot apparatus, detecting breakage of the heater, and outputting a signal requesting exchange for the spare lighter hand to the robot apparatus, if the heater is broken; and a holder tray supplying mechanism and a roll tray supplying mechanism are provided near an end portion of the rail, the holder tray supplying mechanism and the roll tray supplying mechanism holding a plurality of holder trays and roll trays, respectively, the holder trays and roll trays being supplied one by one to an operation range of the robot body, and each of the holder trays and roll trays holding a plurality of holders and tobacco rolls, respectively.

9. The automatic smoking machine according to claim 8, wherein the lighter hand is set to a temperature of 600° C. or higher when the lighter hand is on.

* * * * *